US007589689B2

(12) United States Patent
Welch et al.

(10) Patent No.: US 7,589,689 B2
(45) Date of Patent: Sep. 15, 2009

(54) ANTENNA DESIGNS FOR MULTI-PATH ENVIRONMENTS

(75) Inventors: John Thomas Welch, Orem, UT (US); Gary L. Smith, Lindon, UT (US); Mark James Miner, Orem, UT (US); Jan M. DeHoop, Sandy, UT (US)

(73) Assignee: Ibahn General Holdings Corporation, South Jordan, UT (US)

( * ) Notice: Subject to any disclaimer, the term of this patent is extended or adjusted under 35 U.S.C. 154(b) by 420 days.

(21) Appl. No.: 11/553,950

(22) Filed: Oct. 27, 2006

(65) Prior Publication Data

US 2008/0007472 A1 Jan. 10, 2008

Related U.S. Application Data

(60) Provisional application No. 60/819,030, filed on Jul. 6, 2006.

(51) Int. Cl.
*H01Q 13/10* (2006.01)

(52) U.S. Cl. ..... 343/771

(58) Field of Classification Search ..... 343/771–772, 343/778, 754, 767, 853
See application file for complete search history.

(56) References Cited

U.S. PATENT DOCUMENTS

| | | | | |
|---|---|---|---|---|
| 4,970,522 | A * | 11/1990 | Niman | 342/374 |
| 5,598,172 | A * | 1/1997 | Chekroun | 343/754 |
| 6,421,021 | B1 * | 7/2002 | Rupp et al. | 343/753 |
| 6,822,615 | B2 * | 11/2004 | Quan et al. | 343/754 |
| 6,999,040 | B2 * | 2/2006 | Robertson et al. | 343/772 |
| 2006/0111047 | A1 | 5/2006 | Louberg et al. | |
| 2006/0132369 | A1 | 6/2006 | Robertson et al. | |

OTHER PUBLICATIONS

International Search Report and Written Opinion Of The International Searching Authority dated Dec. 13, 2007, for related PCT Application No. PCT/US2007/72043.

Notification Concerning Transmittal of International Preliminary Report on Patentability dated Jan. 15, 2009 for related PCT Application No. PCT/US2007/72043.

* cited by examiner

*Primary Examiner*—Huedung Mancuso
(74) *Attorney, Agent, or Firm*—Weaver Austin Villeneuve & Sampson LLP

(57) ABSTRACT

Antenna designs for data transmission improve signal fidelity in multi-path environments.

25 Claims, 10 Drawing Sheets

ANTENNA DESIGNS FOR MULTI-PATH ENVIRONMENTS

RELATED APPLICATION DATA

The present application claims priority under 35 U.S.C. 119(e) to U.S. Provisional Patent Application No. 60/819,030 filed on Jul. 6, 2006, the entire disclosure of which is incorporated herein by reference for all purposes.

BACKGROUND OF THE INVENTION

The present invention relates to antenna designs and, more specifically to antenna designs for data transmission which improve signal fidelity in multi-path environments.

Only recently have modern modulation techniques, made possible by recent chipsets, enabled low power short range application of radio frequency devices to become practical or economically feasible for the transfer of high speed data in the radio frequency spectra. The relatively low power levels and high frequencies used in high speed data transfers necessitate the location of antenna close to the intended targets. Most consumer devices of this type are intended to be used at less than one hundred meters. Regulatory bodies in turn place restrictions on the isotropic radiation emitted from these devices. This leads to antenna placement in confined spaces in building interiors such as closets, plenum spaces, etc.

Such enclosed spaces are characterized by much more complex boundary conditions than those for which traditional antennae or antenna arrays were designed. That is, traditional antenna designs addressed the need to transmit and receive telemetry and data effectively over relatively long distances. These legacy designs work best when positioned in an environment of high visibility (e.g., on a hilltop or radio tower) in which the antenna is exposed to low levels of multi-path signals and near field disturbance. Unfortunately, conventional antennae are now being deployed under conditions which are radically different than those for which they were designed. In addition, many antennae are housed in materials which are unsuitable for use in building or other enclosed environments in which it is necessary to keep flame spread and noxious, combustion-induced fumes to a minimum.

Legacy antenna designs deployed in their intended environments are often actually aided by the conditions under which they are deployed. For example, the undesirable multi-path signal element due to signal reflection is attenuated by distance. In addition, over long distances the angle of incidence of reflected signals will typically result in much of the unwanted reflections missing the receiving antenna. However, these conditions do not prevail in today's low power, digital environments. Moreover, because conventional antenna designs have little need to compensate for near field problems they are ill equipped to handle the near field disturbances common in such environments.

Legacy antenna designs are also typically characterized by a broad received spectra. Unfortunately, in low power, digital systems, this characteristic results in eddy currents and hysteresis losses within the transmission cable, as well as reduced sensitivity of the receiving unit.

As mentioned above, modern considerations for digital low power RF systems typically result in less than optimal antenna placement. The locations selected are strongly influenced by the structure in which the system is deployed. The structural characteristics of the deployment environment, in combination with the reactive elements of a conventional antenna, alter the effective impedance of the antenna. This in turn results in decreased performance as well as potential damage to the attached transponder.

A variety of approaches have been used to address issues relating to the use of legacy antenna designs in environments having complex boundary conditions and high multi-path. One set of solutions simply attempts to place the antennae in a high visibility locations. However, although an effective approach, many industries (e.g., hospitality, restaurant, transportation, etc.) strongly object to having antennae in view for reasons of aesthetics. Camouflaged antennae may be placed in more effective locations. However, most indoor environments provide few good options for effective placement with traditional antenna designs.

Under traditional conditions or antenna placements, an increase in antenna gain may be used to narrow the beam width of the antenna, thereby reducing the multi-path component to which the antenna is exposed. This generally requires an increase in the size of the antenna. Unfortunately, in a high multi-path environment such an increase in size is counterproductive in that a larger antenna is exposed to more of the multi-path signals in the environment.

One set of solutions for dealing with multi-path involves the use of specialty polarization schemes. One such solution involves the use of antenna diversity, e.g., port, spatial, or a combination. However, though this approach is useful in managing multi-path, it does nothing for near field problems and, in fact, presents more challenges relating to near field disturbances than the use of a single antenna. Such antenna diversity schemes also may result in a greater chance of equipment damage due to impedance mismatch. In addition, depending on the "flavor of diversity" used, the antennae have to be separated by some distance. This is often impractical in an environment which offers little space. Antenna diversity is also a relatively expensive solution in that it requires at least two antennae and their related hardware.

Circular polarization is a commonly used scheme because of its alleged "inherent immunity" to multi-path. The actually demonstrable benefit of circular polarization is that it accepts linear polarization (i.e. horizontal or vertical and their variances) more or less equally allowing for a best case majority rule. However, the tradeoffs of circular polarization include a relatively large impedance matching network making the antenna susceptible to near field problems, and a wide bandwidth making the antenna susceptible to out of band interferences.

An increase in transmit power (independent of receiver sensitivity) is often used as a means to overwhelm multi-path elements common to crowded or confined environments. Although this method allows for a smaller antenna (thus resulting in lower antenna exposure to the multi-path environment), the increase in applied power tends to exaggerate near field problems.

A variety of active signal processing techniques have also been developed to resolve source signals which are separated in phase by close and near obstructions (i.e., multi-path signals). One example, commonly referred to as MiMo (multiple-in, multiple-out), is a process which uses active components to align out-of-phase signals from a single source as experienced across multiple receiving antennae. Under MiMo, multiple traditional antennae are used and the delay spread is accounted for with complex signal processing techniques which rely on active technology. However, while such an approach may be effective in reducing multi-path for some applications, it is not economically feasible for many of the most common low power, digital systems being deployed today. In addition, MiMo designs are not particularly effective in addressing near field problems. Finally, the processing overhead required for such techniques undesirably affects data throughput.

In view of the foregoing, there is a need for improved antenna designs for use in low power, digital applications and environments characterized by high multi-path and near field problems.

SUMMARY OF THE INVENTION

According to specific embodiments of the invention, an antenna design is provided which includes an aperture component having a plurality of apertures configured to transmit a plurality of signals originating from a single source. The signals are initially out of phase with each other. A waveguide component coupled to the aperture component. A plurality of receive elements are disposed within the waveguide component and configured to receive the signals. The apertures and the receive elements are configured to bring the signals substantially into phase with each other at the receive elements, and to promote constructive interference of the signals at the receive elements in a frequency band of interest. The waveguide component and the receive elements are configured to form a circuit having a frequency response which attenuates signal energy outside of the band of interest A further understanding of the nature and advantages of the present invention may be realized by reference to the remaining portions of the specification and the drawings.

DETAILED DESCRIPTION OF SPECIFIC EMBODIMENTS

Figure 1:
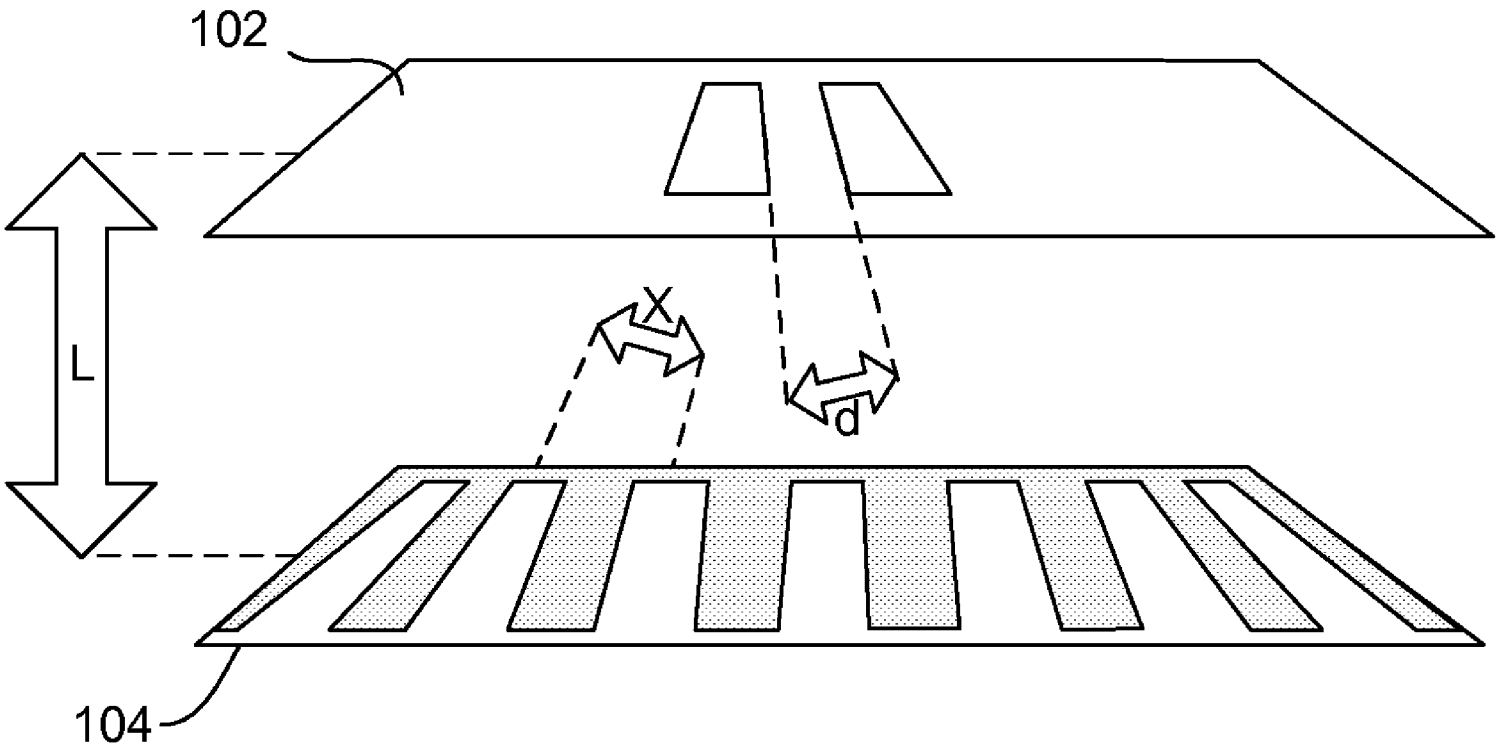
FIG. 1 illustrates the aperture component and the receive elements of an antenna designed according to specific embodiments of the invention.

Reference will now be made in detail to specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the following description, specific details are set forth in order to provide a thorough understanding of the present invention. The present invention may be practiced without some or all of these specific details. In addition, well known features may not have been described in detail to avoid unnecessarily obscuring the invention.

Antennae designed in accordance with specific embodiments the invention combine interdependent effects of apertures and waveguide to bring multi-path signal components into phase before they reach receive elements and to reject signal energy outside of a band of interest. The apertures are configured to receive signals in a frequency band of interest having varying phases and being from different directions into the waveguide. The receive elements are configured within the waveguide such that the signals are substantially in phase and are additively combined upon reaching the receive elements. The combination of these effects results in improved signal strength and fidelity at the receive elements. The increased signal strength and fidelity, in turn, reduces the amount of signal processing required, thereby enabling increased data throughput.

In order for any two out-of-phase signals from the same source to strike the antenna apertures and hit the same receive element, they must be in phase as the distances from the apertures to the receive element are the same for both signals. Thus, to bring the various components of a multi-path signal back into phase, the size and spacing of the apertures, the size and spacing of the receive elements, and the distance between the apertures and the receive elements are controlled to produce this result.

In addition to dealing with the multi-path issue, antenna configurations designed according to embodiments of the invention also provides some measure of band rejection in that the apertures and receive elements are configured specifically for the band of interest. Signals having frequencies outside of this band are much less likely to strike the receive elements as their maxima will not converge additively in the same way as the center frequency for which the design is intended.

According to specific embodiments of the invention, a more significant measure of band rejection is provided by the transfer function of the circuit formed by the antenna components. That is, the reactive components formed by the aperture component, the waveguide component, and the receive elements (and possibly additional components) of which the antenna is constructed are manipulated to reject frequencies outside of the band of interest.

Thus, with the proper design of the antenna waveguide, near field effects caused by nearby metallic objects (e.g., air conditioning ducts or other structural elements) can be greatly reduced or effectively eliminated. This, in turn, enables the installation of the antenna in previously problematic locations inside buildings. For example, antennae designed according to embodiments of the invention can be placed in a capped ceiling that has conduit and environmental pipes. Unlike their effects on conventional antennae, these previously problematic objects will not significantly change the impedance of the antenna. And even though these objects produce a challenging multi-path environment, antennae designed according to various embodiments of the invention mitigate the effects of such an environment to a large degree.

Given that antennae designed in accordance with embodiments of the invention are suitable for deployment in ceilings and crawl spaces, it is desirable to mitigate the possibility that the antenna chambers will become attractive shelter for creatures which typically inhabit such spaces, e.g., rodents, insects, birds, etc. Therefore, according to some embodiments, access to the antenna chambers is prevented or impeded through the use of a highly permeable material (e.g., PVC tape or foam) which is configured to prevent foreign objects from entering the antenna. Such material could take the form of a thin layer in front or behind the apertures or, depending on its transmission characteristics, could fill much or all of the chamber(s).

Antennae designed in accordance with specific embodiments of the invention address many of the same issues that multiple-in, multiple-out (MiMo) designs are intended to address. However, the antennae designed according to such embodiments may be characterized by several significant advantages over MiMo designs. For example, embodiments of the invention can achieve with a single antenna what MiMo designs accomplish with multiple antennae. The passive nature of embodiments of invention significantly reduces signal processing overhead as compared to MiMo designs; processing power which can be used to increase data throughput. Antennae designed according to specific embodiments of the invention may also greatly reduce near field effects, an issue not adequately addressed by MiMo designs. And because only one antenna is required, system installations according to embodiments of the invention have smaller footprints and are easier to install than MiMo installations. It should be noted that antennae designed in accordance with embodiments of the invention could be used as the antennae in a MiMo system to enhance such a system with better bandwidth selection and impedance tolerance of the surrounding infrastructure in which the antennae are placed.

Antennae designed in accordance with embodiments of the invention may be deployed in a wide variety of systems and applications. Examples of such applications include, but are not limited to, a wireless access point, a wireless router, a wireless gateway, etc. More specific implementations are intended for use in systems designed in accordance with the IEEE 802.11 family of standards relating to wireless networks, i.e., IEEE 802.11b, 802.11g, 802.11a, 802.16, etc. Other applications include, for example, mass spectrum analyzers, radio imaging equipment, etc. Generally speaking, any application in which multi-path signals or near field disturbances are an issue may benefit from antenna designed in accordance with the invention.

According to specific embodiments of the invention, an antenna includes a tuned cavity waveguide or housing which provides frequency isolation and impedance match, an aperture component which, by its placement, distance to the receive elements, and slot separation provides correction for out of phase signals, and an array of receive elements which matches the pattern presented by the apertures. According to more specific embodiments, the receive elements are configured on a circuit board which also includes delay lines for maintaining phase to the antenna connector point.

The antenna performs a phase correction of delay spread to signals passing through the apertures, and operates in a narrow band of operation giving a high amount of rejection to out of band signals. The near field effect is greatly reduced enabling implementations in which antennae designed in accordance with embodiments of the invention are stacked on top of one another and/or work effectively under conditions where traditional antennae would break down in performance.

The receive elements imprinted on the receive element circuit board are etched where the frequency of interest has interfered constructively, i.e., where a crest of a wave meets a crest. The regions of destructive interference, i.e., where a crest meets a trough, have no receive elements on the circuit board. Thus, the design is dependent on lambda (i.e., the wavelength corresponding to the frequency of interest) in that out of band frequencies are limited in convergence (i.e., less likely to be present) on the area of the circuit board where the receive elements are present.

Figure 2:
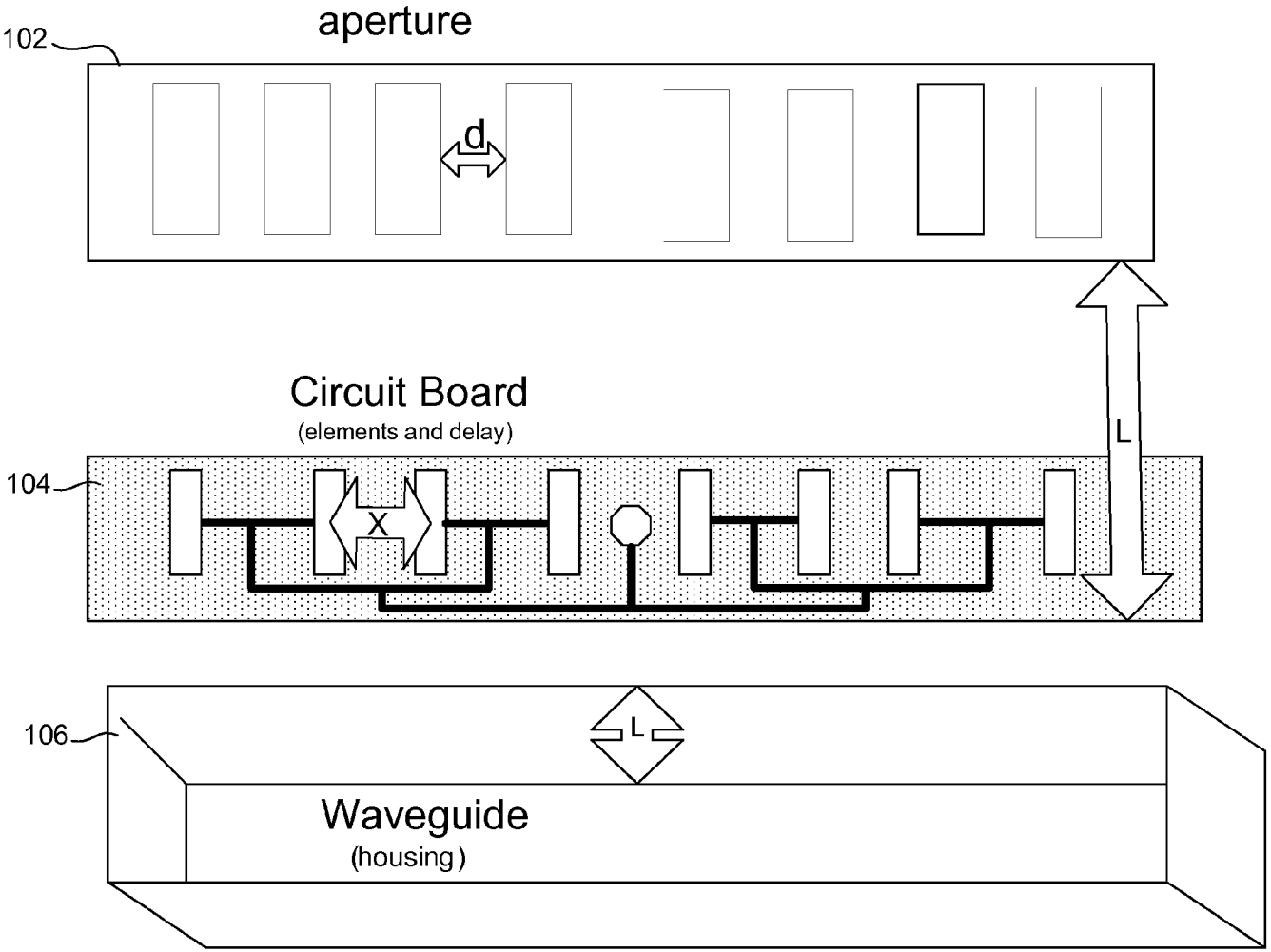
FIG. 2 illustrates the aperture component, the waveguide, and the receive elements of an antenna designed according to specifics embodiment of the invention.

The relationships among the various components of an antenna designed according to specific embodiments of the invention are illustrated in FIGS. 1 and 2 and may be represented by $$\frac{n\lambda}{d} = \frac{x}{L} \text{ and} \tag{1}$$

$$n\lambda = \frac{xd}{L} \tag{2}$$

where λ is the wavelength of the frequency of interest, d is the separation of the slits in aperture component 102, x is the distance between the bands of additive multi-path (also called the fringe distance), L is the distance from aperture component 102 to receive element circuit board 104, and n is the order of maxima observed.

Figure 3:
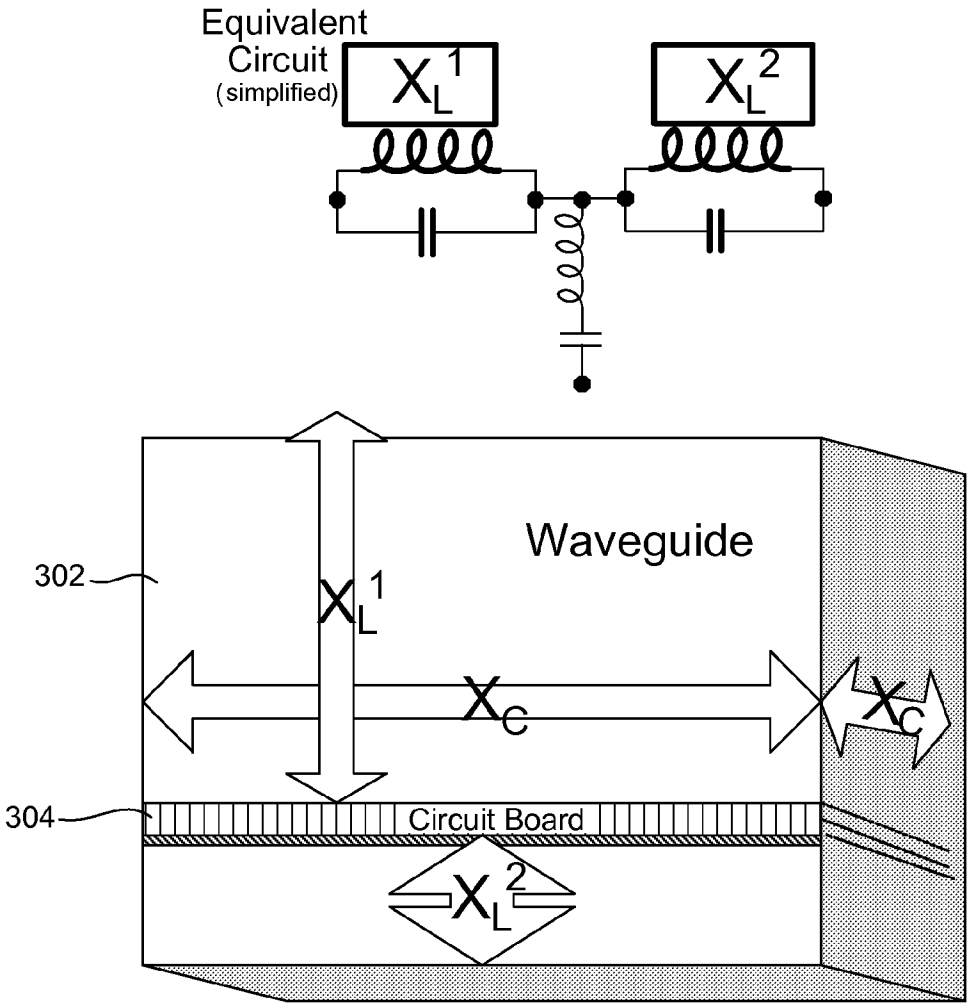
FIG. 3 illustrates the relationship between the waveguide and the receive elements of an antenna designed according to specific embodiments of the invention.

The relationship between waveguide 106 and receive element circuit board 104 is such that together they form a band pass filter around the frequency of interest. This may be understood with reference to the exemplary configuration of FIG. 3. As shown, the size and shape of waveguide 302, and the relative sizes of the two chambers defined by the receive element circuit board 304 define equivalent reactance values $X_L^1$, $X_L^2$, and $X_C$. The reactive elements of the circuit (including but not solely referring to the antenna elements) achieve or approach resonance at a broad range of frequencies other than the frequency of interest. In the embodiment illustrated, the waveguide and the circuit board together form dual band rejection circuits in the form of tank circuits, i.e., two band rejection filters on either side of the frequency of interest. These parameters may be manipulated to achieve a wide variety of frequency responses and a corresponding measure of frequency rejection. That is, it should be understood that the configuration and equivalent circuit shown are merely an example of an antenna design having characteristics enabled by the present invention, and that different configurations represented by different equivalent circuits (including series implementations, parallel implementations, and series-parallel combinations) may be used without departing from the scope of the invention. According to a specific embodiment, the relationship between the circuit board and the waveguide may be such that frequencies across a broad band approaching but not including the frequency of interest are suppressed on the low end by a high amount of capacitive reactance and at the high end by a large amount of inductive reactance.

According to some embodiments, the antenna may have a high Q or "figure of merit" which corresponds to a very narrow bandwidth around the center frequency. According to such embodiments, antenna components may be manipulated and/or introduced to "smear" the bandwidth out so as to encompass a wider band of interest around the antenna's center frequency. This may be done by adjusting a variety of antenna parameters including, for example, the position of the receive element circuit board in the antenna waveguide. Alternatively, the thickness of the receive element circuit board could be manipulated to alter the antenna bandwidth.

As described above, the predominant reactive components in the circuit formed by the antenna components are dependent on the interior size of the waveguide and the relative positions of the elements within the waveguide. As a result, external objects within close proximity of the antenna (even ferric objects) have a negligible effect on antenna operation. That is, the highest reactance of the circuit formed by the antenna components is at frequencies other than the frequency of interest thereby limiting the near field effects of the antenna. According to a specific embodiment, the waveguide is constructed of a highly impermeable substance (e.g., copper alloys) further limiting near field effects.

Figure 4:
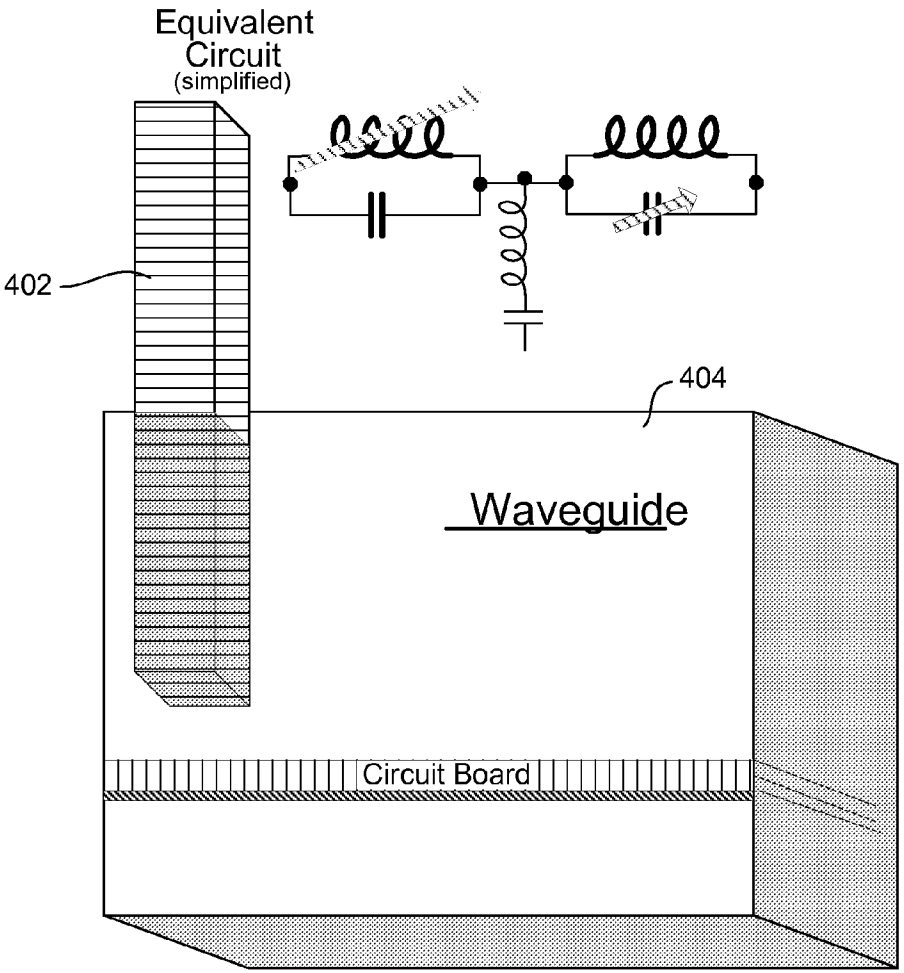
FIG. 4 illustrates the relationship between the waveguide and the receive elements of an antenna designed according to specific embodiments of the invention.

As described above, the wavelength accepted by antennae designed according to particular implementations of the invention is at least partially dependent on the size of the chambers within the waveguide. Therefore, according to specific embodiments of the invention, the effective size of one or more of these chambers may be altered to change the frequency to which the antenna is tuned. An example of one such embodiment is shown in FIG. 4. As illustrated, a waveguide insert 402 may be progressively introduced into or removed from one or more of the chambers of waveguide 404 to cause the size or volume of the chamber to be altered. As illustrated by the equivalent circuit shown in the figure, this has the effect of making at least some of the reactive elements of the antenna circuit adjustable.

It will be understood that the mechanism shown in FIG. 4 is largely symbolic of a broad class of mechanisms for tuning an antenna, and that a wide variety of mechanical means, either manual or programmable, could be employed to affect or alter the size or volume of the waveguide chamber(s) and tune the antenna to a specified frequency. For example, according to some embodiments, the waveguide insert may have components which simultaneously reduce the sizes of both the upper and lower chambers separated by the receive elements. According to one such embodiment, the relative reduction in chamber size for each chamber is comparable to the other. In general, any mechanism which has the effect of making at least one of the reactive components of the antenna circuit adjustable is within the scope of the invention.

In addition to providing a tuning capability, the tuning mechanism can also be used to feed electromagnetic energy into the antenna for transmission. That is, the tuning mechanism can also be employed as the antenna feed either in combination with, or instead of, a more conventional connector feed. Alternatively, the connector feed may also be used to effect some level of tuning. That is, the cable feed associated with the connector could be adjustably inserted in the waveguide chamber.

Additional tuning capability may be introduced using, for example, a capacitor, an inductor, or other passive device in the antenna waveguide, e.g., from the connector to the waveguide. Such passive devices might be added for fine tuning, e.g., to account for production run differences.

According to various embodiments, the gain of an antenna designed in accordance with the invention may be controlled using a variety of techniques. For example, apertures may be added or removed (e.g., by opening or closing them), or by restricting them in a way that does not influence the spacing between them. Alternatively, selected receive elements may be turned on and off, or enabled and disabled in some way. In another example, the gain may be controlled without influencing the impedance by slight variations in the focus of the antenna. This may be achieved, for example, by moving the aperture component or the receive elements (or a circuit board on which they are disposed) laterally allowing less of the fringe bands associated with maxima, and more of the fringe bands associated with minima to reach the elements.

Figure 5:
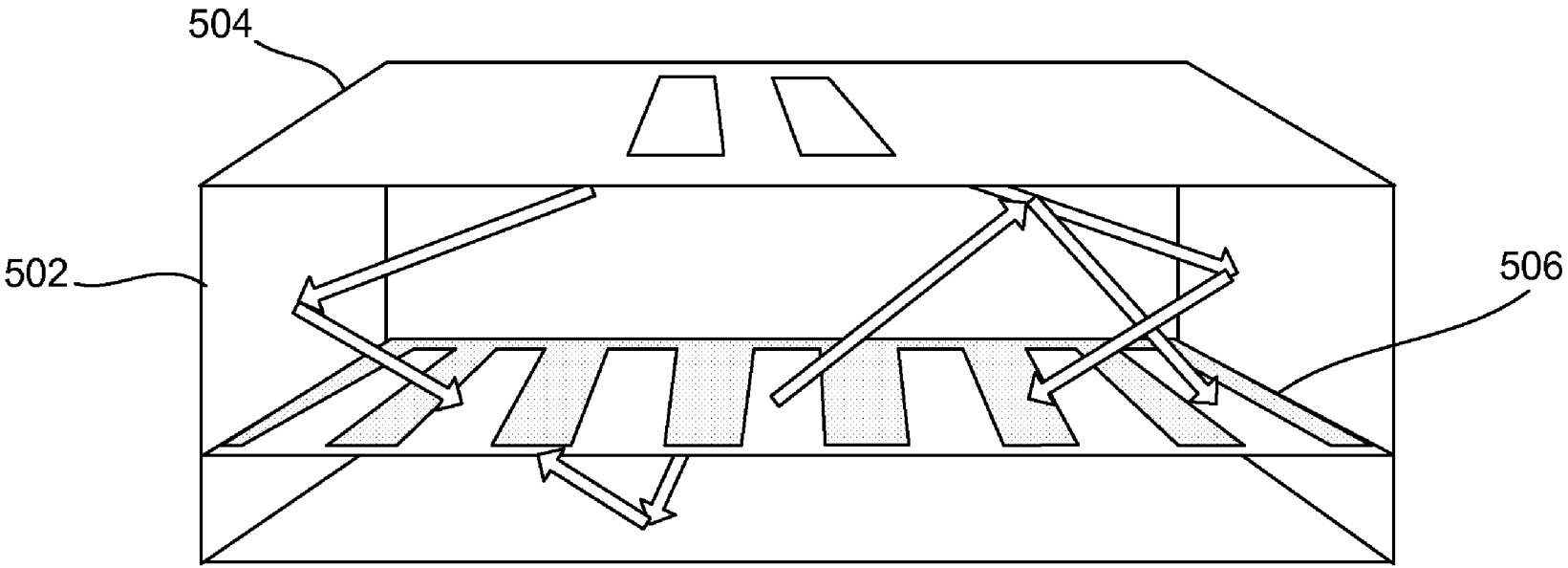
FIG. 5 illustrates the aperture component, the waveguide, and the receive elements of an antenna designed according to specific embodiments of the invention.

According to specific embodiments of the invention, reflective surfaces within the waveguide are employed to promote reflection of received signals to the receive elements. That is, some level of reflection off of the various internal surfaces of the antenna already takes place. In addition to that, embodiments are contemplated in which the reflectivity of internal surfaces are controlled in some way to improve performance. For example, various internal surfaces may be polished or otherwise modified (e.g., coated, electroplated, or ionized) with highly reflective materials or materials to promote reflection for the purpose of increasing the antenna gain, or reducing eddy currents, hysteresis effects, or magnetic field effects of the antenna. As shown in FIG. 5, these surfaces may include, for example, the internal surfaces of waveguide 502, the underside of aperture component 504, and/or the backside of receive element board 506.

Figure 6:
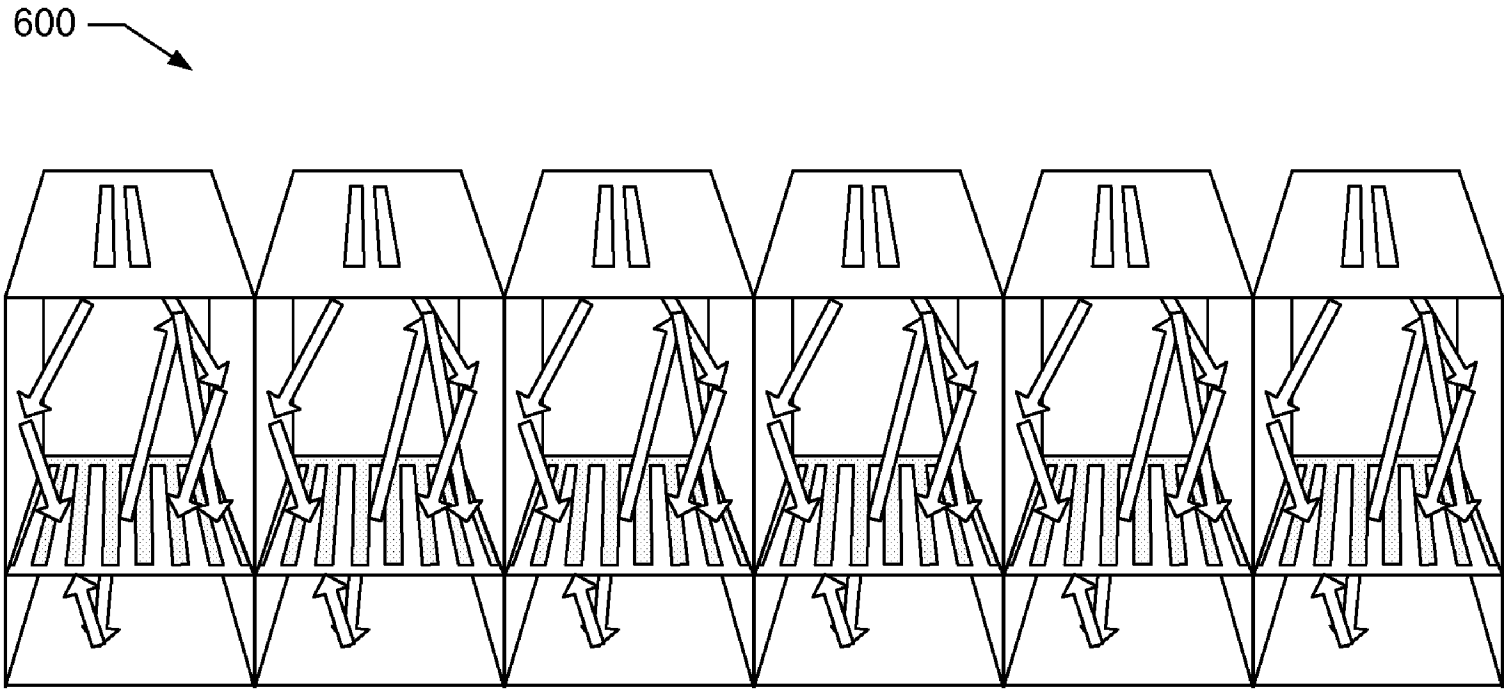
FIG. 6 shows an array of antennae designed in accordance with embodiments of the present invention.

In addition, because of the mitigation of near field effects, implementations are contemplated in which antennae designed in accordance with specific embodiments of the invention are stacked or configured in arrays such as array 600 as illustrated in FIG. 6. Such arrays can operate, for example, as phased antenna arrays. Antennae designed in accordance with such embodiments are particularly advantageous in such applications in that they eliminate the diode recovery time required in conventional phased arrays to switch from one phase to another.

As an alternative to arrays which include multiple antennae, some implementations may segment or partition a single waveguide in such a way as to group subsets of apertures and receive elements into individual operational units within the single antenna. Such partitioning could be effected, for example, by inserting physical partitions in the waveguide. In some cases, the partitions may be substantially equal in size and operate, for example, as a phased antenna array. In other cases, the partitions may be unequal in size such that each partition and the associated apertures and receive elements are characterized by their own frequency of operation, thus achieving a multi-antenna, multi-frequency system.

Embodiments of the invention may also be used in environments which are not characterized by high multi-path. However, some of the benefits of such embodiments which depend on the presence of multi-path signals may not be entirely realized. That is, because of the relatively low incidence of multi-path signals in such environments, there will be a correspondingly lower incidence of additive signal components on the receive components, and the receive band will not be as well defined. Therefore, according to some embodiments, at least one additional aperture component is disposed adjacent (e.g., in front of) the antenna's main aperture component. Such an additional aperture component might be a piece of metal with a few random perforations disposed a few inches away from the antenna's aperture. This has the effect of duplicating a high-multi-path environment such that particular benefits of the invention may still be realized.

Figure 7:
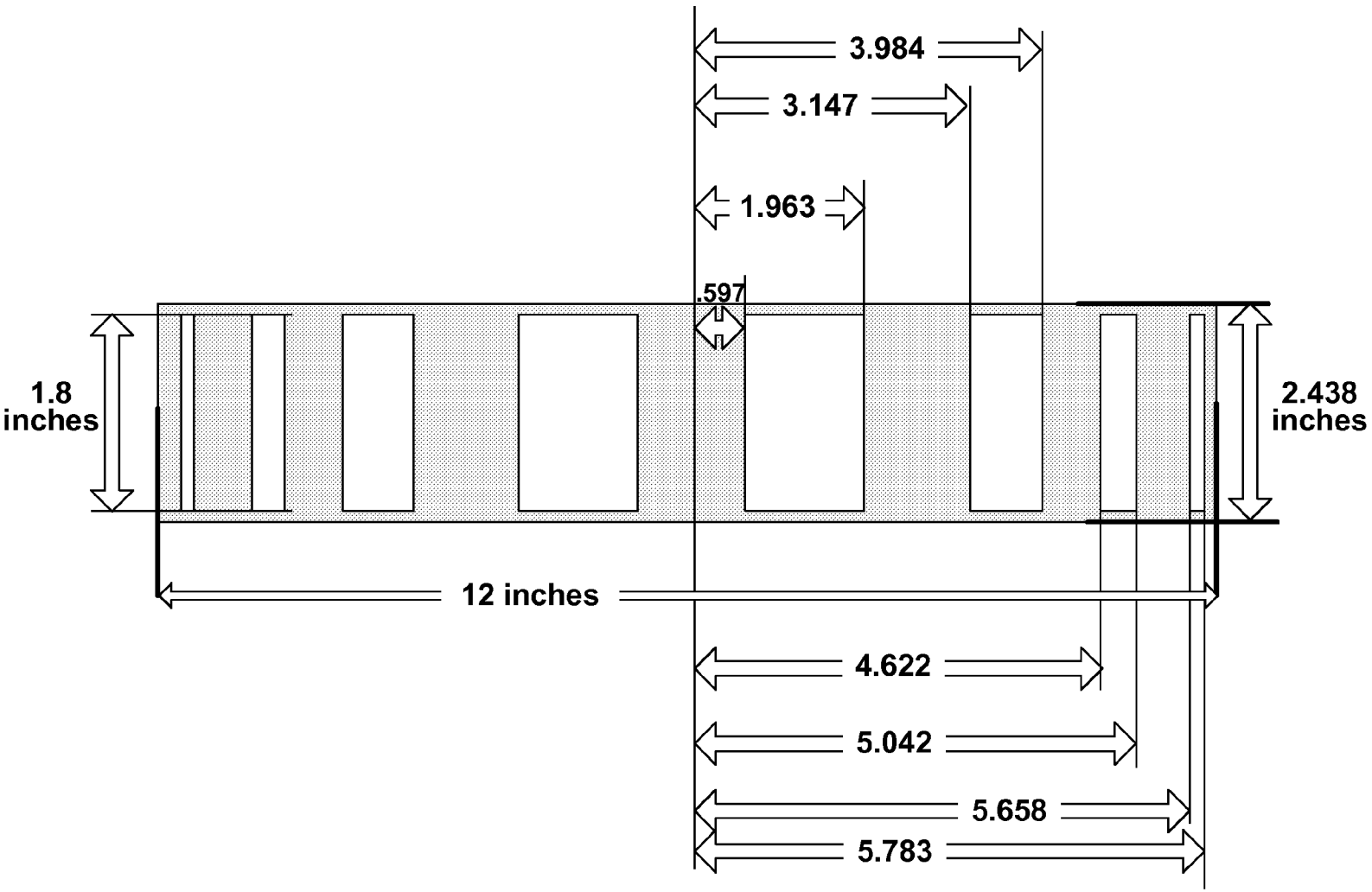
FIGS. 7-10 illustrate the dimensions of a particular implementation.
Figure 8:
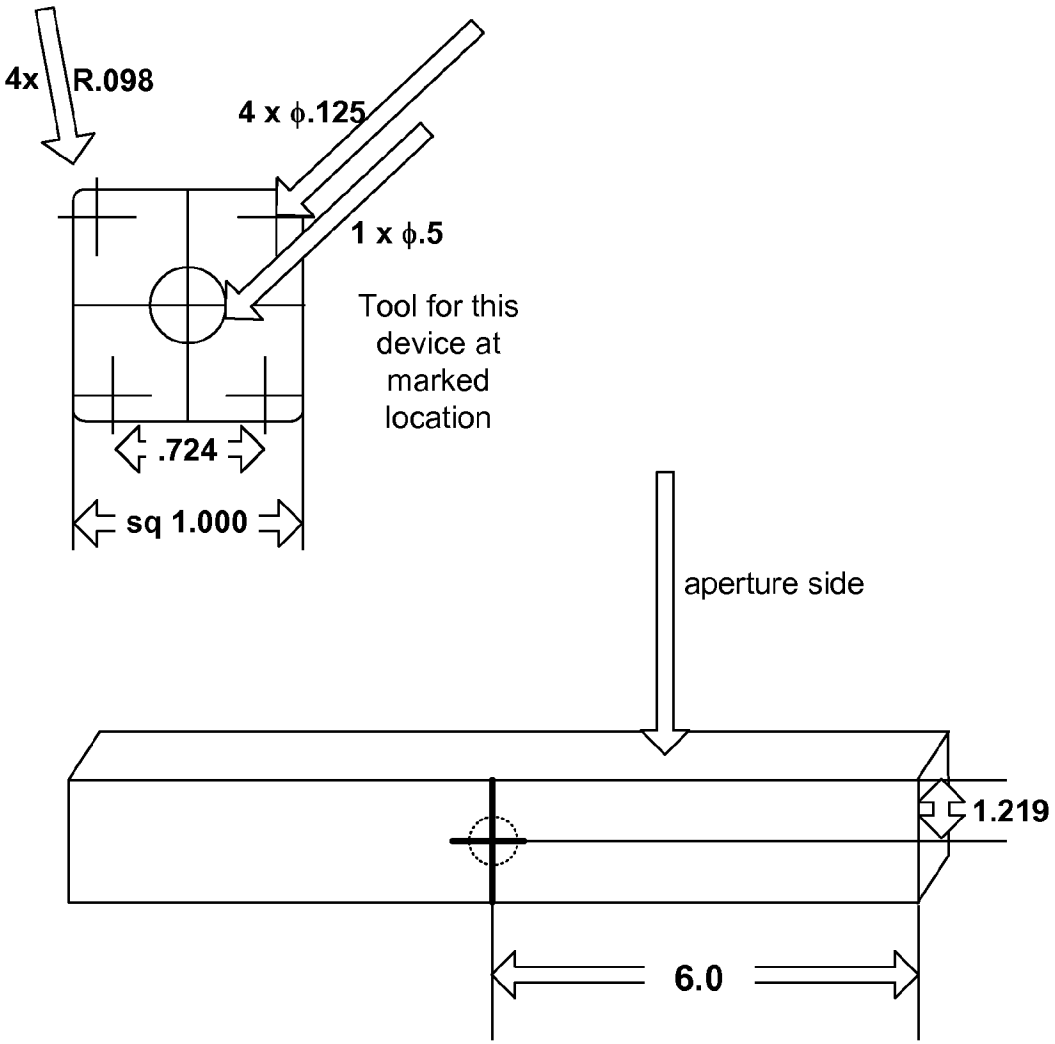
Figure 9:
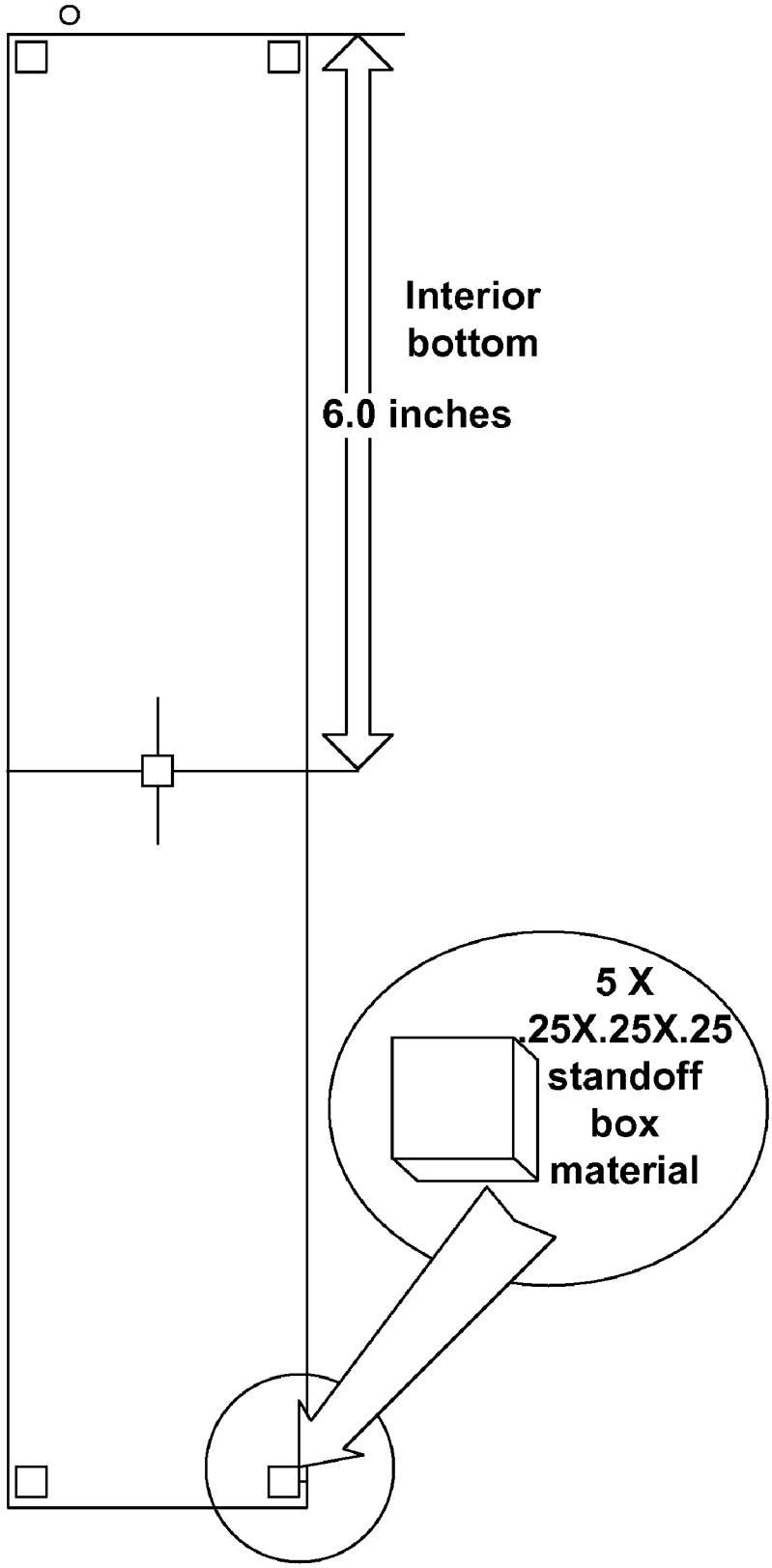
Figure 10:
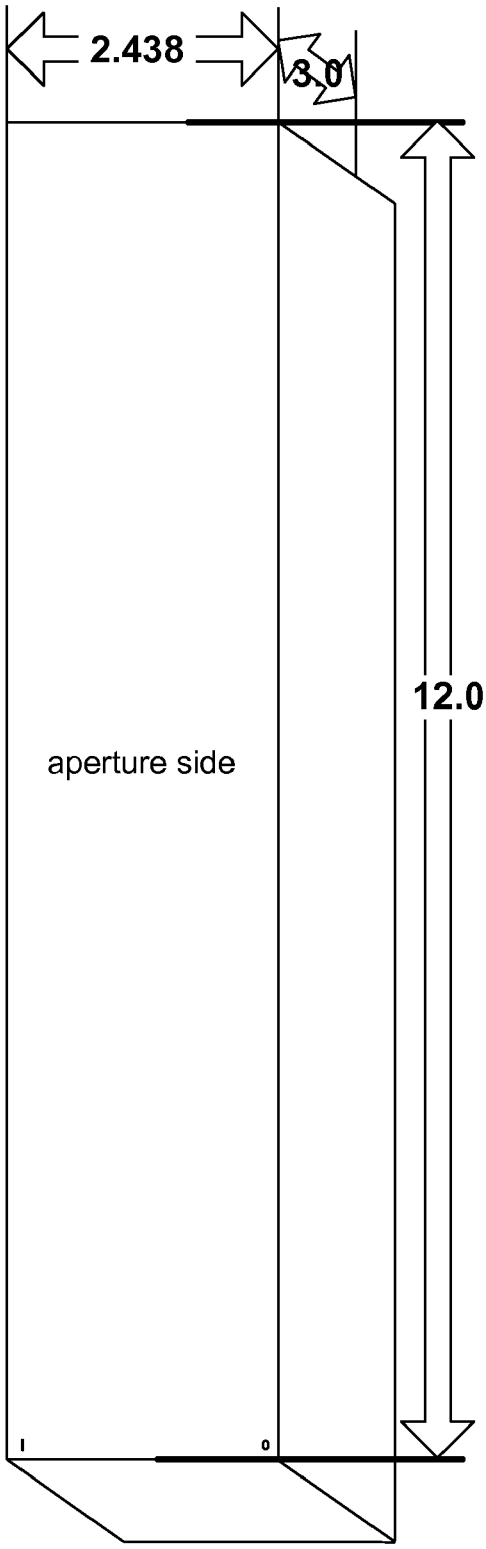

The dimensions of a specific implementation of an antenna 700 intended for use in a wireless networking application are shown in FIGS. 7-10. As will be understood, the dimensions shown are merely examples which are appropriate for the intended application, and should not be used to limit the scope of the invention. As can be seen in FIG. 7, apertures 702 toward the ends of antenna 700 are narrower and differently spaced then apertures 704 near the center of the antenna. These differences were determined empirically to account for reflections which occur, for example, at the end caps of the antenna. That is, the reflective angle of incidence within the waveguide chamber appears from the reference point of the circuit board to be coming from another aperture. So, mathematically, from the point of view of the circuit board the apertures are equidistant. Put another way, the aperture widths and spacing in this embodiment account for internal reflections to ensure that the signals are received in phase.

While the invention has been particularly shown and described with reference to specific embodiments thereof, it will be understood by those skilled in the art that changes in the form and details of the disclosed embodiments may be made without departing from the spirit or scope of the invention. For example, embodiments have been described in which the receive elements are disposed in a plane which is parallel to another plane in which the apertures are disposed. However, embodiments are contemplated in which the apertures and receive elements are not necessarily configured in this manner. For example, reflection paths within the waveguide chamber can be constructed such that the optimal receive element locations have a different distribution, e.g., in a plane perpendicular to the plane of the apertures. Thus, any configuration of apertures and receive elements which produces the multi-path mitigation effect described herein is within the scope of the invention.

Embodiments are also contemplated which employ different polarizations, e.g., horizontal, vertical, circular, or elliptical. This may be accomplished, for example, by suitably altering the shapes, positioning, and/or distribution of the apertures to achieve the desired polarization. Polarization filters may also be introduced, e.g., ahead of or behind the aperture component, in order to improve performance.

Directional, sectoral, or omni-directional implementations are also contemplated. For example, an omni-directional antenna may be implemented in accordance with the invention in which the aperture component could be cylindrical, the receive elements could be disposed along an internal cylindrical surface concentric with the aperture cylinder, and the waveguide chambers could be defined by caps or terminations on both ends of the cylinders. In addition, the shape of the aperture component may be manipulated to effect a wide variety of propagation patterns. For example, the aperture component may be characterized by degrees of convexity or concavity to achieve a desired dispersal or focus of reception and transmission. In addition, the waveguide component may be characterized by a variety of shapes including, for example, cubical, rhomboid, spherical, oblique spherical, cylindrical, toroidal, or parabolic. Therefore, it should be understood that a wide range of such embodiments is within the scope of the invention.

Embodiments are also contemplated in which the receive elements are not disposed on a circuit board as shown in some of the figures. Rather, the receive elements may be suspended within the waveguide using some other mechanism such as, for example, a stiff, metal member extending from the connector or the side of the waveguide. Any intervening spaces between receive elements in such an implementation could be filled with additional shielding material, e.g., in the form of a split shield extending from the connector or the waveguide walls, such that the chambers in the waveguide are suitably defined. Suspended receive element may also be included in embodiments having a receive element circuit board to augment the receive elements on the circuit board.

Various embodiments of the invention have been described herein with reference to particular mechanisms or components. It should be understood, however, that embodiments are contemplated in which various combinations of such mechanisms or components are included. For example, an antenna designed in accordance with the invention may include mechanisms for both tuning the antenna as well as adjusting the gain. More generally, any combination of features and configurations described herein which results in an operable antenna is within the scope of the invention.

Furthermore, components may be added to antennae implemented in accordance with embodiments of the invention without departing from the scope of the invention. For example, at least one active or passive external element may be added to an antenna to transmit electromagnetic energy to and from its apertures. Such an addition might be included, for example, to effectively increase the size of the antenna and therefore the amount of energy being received.

In addition, although various advantages, aspects, and objects of the present invention have been discussed herein with reference to various embodiments, it will be understood that the scope of the invention should not be limited by reference to such advantages, aspects, and objects. Rather, the scope of the invention should be determined with reference to the appended claims.

What is claimed is:

1. An antenna, comprising:

an aperture component having a plurality of apertures configured to transmit a plurality of signals originating from a single source, the signals initially being out of phase with each other;

a waveguide component coupled to the aperture component; and a plurality of receive elements disposed within the waveguide component and configured to receive the signals;

wherein the apertures and the receive elements are configured to bring the signals substantially into phase with each other at the receive elements, and to promote constructive interference of the signals at the receive elements in a frequency band of interest, and wherein the waveguide component, and the receive elements are configured to form a circuit having a frequency response which attenuates signal energy outside of the band of interest.

2. The antenna of claim 1 wherein the circuit comprises at least one reactive component which is substantially unaffected by structures external to the antenna.

3. The antenna of claim 2 wherein the at least one reactive component corresponds to at least one chamber in the waveguide component.

4. The antenna of claim 1 further comprising a waveguide insert operable to selectively tune the frequency response of circuit.

5. The antenna of claim 4 wherein the waveguide insert is also operable to feed electromagnetic energy to the antenna for transmission.

6. The antenna of claim 1 further comprising at least one gain adjusting mechanism operable to adjust a gain of the antenna, wherein the at least one gain adjusting mechanism is operable to adjust the gain by one or more of adding and removing apertures, enabling and disabling receive elements, or varying a focus of the antenna by moving one or more of the aperture component and the receive elements.

7. The antenna of claim 1 wherein the aperture component comprises a surface which is substantially parallel to a surface defined by the configuration of the receive elements.

8. The antenna of claim 1 wherein the apertures are configured to effect one of a horizontal polarization, a vertical polarization, circular polarization, or elliptical polarization.

9. The antenna of claim 1 further comprising at least one reflective surface within the waveguide component, wherein the at least one reflective surface is disposed on one or more of an inner surface of the waveguide component, or a back surface of a circuit board on a front surface of which the receive elements are configured.

10. The antenna of claim 1 wherein the receive elements are configured on a circuit board disposed within the waveguide component such that at least one chamber in the waveguide component is defined, a size of the at least one chamber being at least partially determinative of the frequency response of the circuit.

11. The antenna of claim 10 wherein additional receive elements are independently disposed within the waveguide component thereby augmenting the receive elements configured on the circuit board.

12. The antenna of claim 1 wherein the receive elements are suspended within the waveguide component along with additional shielding material such that at least one chamber in the waveguide component is defined, a size of the at least one chamber being at least partially determinative of the frequency response of the circuit.

13. The antenna of claim 1 wherein the aperture component, the waveguide component, and the receive elements are configured to form one of a directional antenna, a sectoral antenna, or an omni-directional antenna.

14. The antenna of claim 1 wherein the waveguide component is characterized by a shape which is one of cubical, rhomboid, spherical, oblique spherical, cylindrical, toroidal, or parabolic.

15. The antenna of claim 1 further comprising at least one partition disposed within the waveguide component thereby forming a plurality of partitions within the waveguide, each partition having a subset of the apertures and a corresponding subset of the receive elements associated therewith, wherein the partitions are one of substantially equal in size and operate as a phased antenna array, or unequal in size with each partition and the associated apertures and receive elements being characterized by a corresponding frequency of operation.

16. The antenna of claim 1 wherein at least a portion of an internal surface of the waveguide component is one of coated, electroplated, or ionized to promote reflection of received electromagnetic energy.

17. The antenna of claim 1 wherein the circuit corresponds to an equivalent circuit having a plurality of reactive components, the reactive components being arranged in series, in parallel, or a combination of series and parallel.

18. The antenna of claim 1 further comprising a feed cable coupled to the receive elements, wherein the circuit includes the feed cable.

19. The antenna of claim 1 wherein the aperture component is one of substantially convex or substantially concave relative to a chamber formed by the wave guide.

20. The antenna of claim 1 wherein the circuit comprises an additional reactive circuit component disposed within the waveguide component to adjust the frequency response.

21. The antenna of claim 1 further comprising one or more of at least one polarization filter adjacent the aperture component, at least one active or passive external element configured to transmit electromagnetic energy to and from the apertures, or at least one additional aperture component adjacent the aperture component.

22. The antenna of claim 1 wherein the aperture component is covered by a highly permeable material configured to prevent foreign objects from entering the antenna.

23. A system comprising at least one instance of the antenna of claim 1.

24. The system of claim 23 comprising one of a wireless access point, a wireless router, a wireless gateway, a mass spectrum analyzer, or radio imaging equipment.

25. The system of claim 23 wherein the at least one instance of the antenna comprises a plurality of instances of the antenna configured as one of an antenna stack or a phased antenna array.

* * * * *